United States Patent [19]

Freeman et al.

[11] 4,369,839

[45] Jan. 25, 1983

[54] CASING VACUUM SYSTEM

[75] Inventors: Ronnie D. Freeman; Elton R. Payne, both of Trent, Tex.

[73] Assignee: F & P Production Co., Inc., Trent, Tex.

[21] Appl. No.: 293,257

[22] Filed: Aug. 17, 1981

[51] Int. Cl.[3] ..... E21B 43/00

[52] U.S. Cl. ..... 166/53; 166/65 R; 166/68.5; 166/369

[58] Field of Search ..... 166/53, 65 R, 68.5, 166/75 R, 105, 105.1, 105.5, 369, 370

[56] References Cited

U.S. PATENT DOCUMENTS

| | | | |
|---|---|---|---|
| 1,858,847 | 5/1932 | Young | 166/105 |
| 1,877,915 | 9/1932 | Lewis | 166/370 |
| 2,119,737 | 6/1938 | Coberly | 166/68.5 |
| 2,828,818 | 4/1958 | Wright . | |
| 3,493,050 | 2/1970 | Kelley . | |
| 3,709,292 | 1/1973 | Palmoul | 166/105.5 |
| 3,837,399 | 9/1974 | Allen . | |
| 4,171,017 | 10/1979 | Klass . | |

*Primary Examiner*—Stephen J. Novosad
*Assistant Examiner*—Joseph Falk
*Attorney, Agent, or Firm*—Richards, Harris & Medlock

[57] ABSTRACT

A casing vacuum system which applies a controlled vacuum to the space within the casing of an oil well in order to maintain the gas pressure in the well within a certain range and thereby improve the recovery of petroleum from the well. A preferred embodiment of the casing vacuum system utilizes a vacuum pump (10) driven by a motor (18) to provide a vacuum. A water accumulator (14) protects the vacuum pump from water damage. A condensate accumulator (16) collects the gas drawn from the well and condenses a portion of it into liquid hydrocarbons. A mercury vacuum switch (30) maintains the gas pressure in the well within the optimum range for recovery of petroleum by stopping the vacuum pump when the pressure is near the lower end of the optimum range and starting the vacuum when the pressure is near the higher end of the optimum range.

7 Claims, 3 Drawing Figures

CASING VACUUM SYSTEM

TECHNICAL FIELD

The invention relates to an apparatus for increasing the production from oil wells, particularly low volume wells commonly known as stripper wells.

BACKGROUND ART

In the recovery of petroleum from subterranean formations, a bore hole is formed into the earth and through the producing formation. Production casing is run into the completed bore hole and is cemented in place. The casing is then perforated to provide communication between the producing formation and the interior of the casing.

In many instances there is initially sufficient formation pressure to cause the petroleum to flow from the producing formation upwardly through the casing to the surface. As the formation pressure is gradually reduced, it eventually becomes advantageous to employ artifical lift to enhance the flow of petroleum from the formation. One of the most commonly used types of artificial lift apparatus is known as a down hole pump.

A typical down hole pump includes a standing valve mounted at the bottom of a string of well tubing which extends downwardly from the surface. A traveling valve is mounted for reciprocation within the well tubing, and is connected to the familiar walking beam type of pumping apparatus by a series of sucker rods. Upon actuation of the walking beam pumping unit, the traveling valve is reciprocated relative to the standing valve to effect pumping of petroleum out of the producing formation and upwardly to the surface through the well tubing.

It is known that gas pressure exists within the well casing. If this pressure is above a certain level, it will cause the down hole pump to stop functioning (i.e., the pump will gas lock). When this happens, the flow of oil from the well is stopped or at least substantially impeded. On the other hand, if the gas pressure within the casing is reduced below a certain level, the flow of oil from the well will be reduced. It is believed that the reduced pressure causes the gas within the petroleum to vaporize. This vaporization causes a foaming action which substantially impedes the proper functioning of the down hole pump. Therefore, in order to optimize production, it is imperative that the gas pressure in the well be maintained within a certain range. The gas pressure which optimizes production depends on such factors as the depth of the well, the level of the fluid in the well, and the normal gas pressure within the well. The optimum gas pressure range will obviously vary from well to well.

It is commonly known that applying an uncontrolled vacuum to the well will relieve the gas pressure. This is currently accomplished by simply attaching a vacuum pump directly to the well casing. There are three problems with this. First, the gas within the well contains a certain amount of water vapor. When the surface temperature is lower than the temperature within the well, the vapor will condense into water. The vacuum pump will eventually be ruined if the water or water vapor passes through it. Second, the gas pumped from the well is simply vented into the atmosphere. This gas is a valuable energy source and should be collected, not wasted. Third, the vacuum is not controlled and will reduce the well pressure below the optimum level. As discussed previously, this will impede the proper functioning of the pump and reduce the flow of oil from the well.

SUMMARY OF THE INVENTION

The present invention eliminates the foregoing problems by providing a system which applies a controlled vacuum to the well casing. In addition, the system contains components to protect the vacuum source and collect the gas.

The system comprises a water accumulator positioned between the well casing and the suction inlet of the vacuum source. The water accumulator absorbs the water vapor in the gas drawn from the well and thereby prevents damage to the vacuum source. A condensate accumulator is positioned on the pressure outlet side of the vacuum source. The condensate accumulator condenses a portion of the gas, collects liquid hydrocarbons and directs any remaining gas to a retention point.

An automatic pressure control is used to maintain the pressure within the well in the optimum range by controlling the application of the vacuum. The automatic pressure control operates by pulsing the vacuum source (i.e., shutting off the vacuum source when the well pressure is reduced below a predetermined level and turning the vacuum source back on when the pressure builds above the predetermined level).

BRIEF DESCRIPTION OF DRAWINGS

A more complete understanding of the invention may be had by reference to the following Detailed Description when taken in conjunction with the accompanying Drawings, wherein.

DETAILED DESCRIPTION

Figure 1:
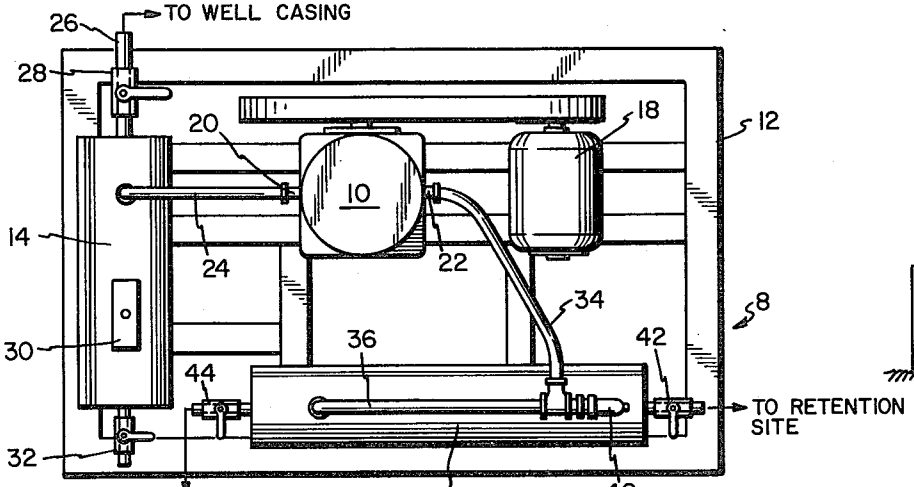
FIG. 1 is a top view of one embodiment of the present invention.

Referring to FIG. 1, there is shown a preferred embodiment of the present invention. The casing vacuum system 8 basically comprises a vacuum pump 10, a motor 18, a water accumulator 14 and a condensate accumulator 16, all mounted on a frame 12.

The vacuum pump 10, having a suction inlet 20 and a pressure outlet 22, is driven by motor 18 and provides the vacuum source for the system. One such vacuum pump is Model No. R17V2 manufactured by Quincy Compressor Division of Colt Insutries, Inc. of Quincy, Ill. Motor 18 can be either an electric motor as shown, or in the alternative, a gasoline, diesel or other type of engine. In the preferred embodiment, an electric motor is used to facilitate the pulsing of the vacuum. One such electric motor is Model No. C145T17FB2A manufactured by Lesson Electric, Inc. of Grafton, Wis.

The water accumulator 14 is connected to the suction inlet 20 of vacuum pump 10 by line 24, and prevents water and/or water vapor from entering vacuum pump 10. Line 26 connects the water accumulator 14 to the well casing. Vacuum inlet valve 28 allows regulation of the vacuum applied to the well casing and is positioned in line 26 between the water accumulator 14 and the well casing. In the preferred embodiment, the water accumulator 14 is an eighteen inch long piece of six inch diameter, ⅜ inch thick steel pipe with ⅜ inch thick steel pipe nipples welded over each end. A bleed valve 32 is located in one end of water accumulator 14 and allows any condensed water vapor to be drained therefrom. Mercury vacuum switch 30 is located on water accumulator 14 and functions to maintain the pressure in the well casing within the optimum range by shutting off the vacuum pump 10 when the pressure is near the lower end of the optimum range and turning vacuum pump 10 back on again when the pressure is near the upper end of the optimum range.

The optimum gas pressure range is determined experimentally for each separate oil well as follows. The rate at which the down hole pump normally extracts fluid from the well is noted. Next, the casing vacuum system 8 is attached to the casing of the oil well and activated. The gas pressure range is arbitrarily set for a range which experience has demonstrated to be effective in an oil well of similar character (i.e., depth, level of fluid, normal gas pressure, etc.). Normally, the down hole pump rate will increase. The down hole pump rate is then monitored periodically and the range adjusted until a higher rate is no longer achieved. The range at which the highest rate is achieved becomes the optimum gas pressure range.

Figure 2:
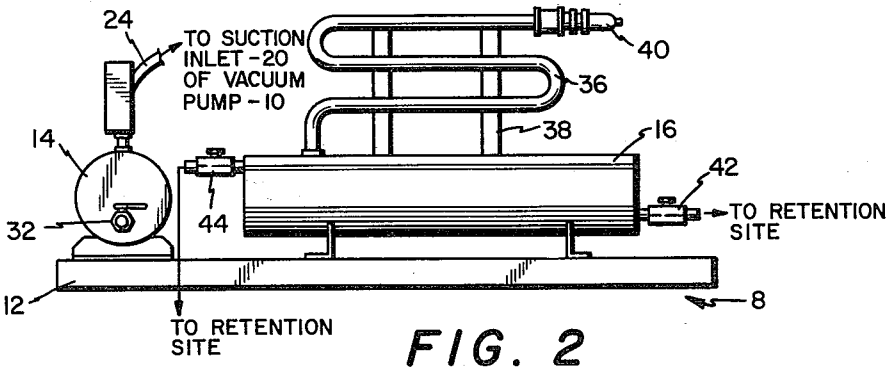
FIG. 2 is a front view of the embodiment of FIG. 1.

Referring to FIGS. 1 and 2, there is shown a condensate accumulator 16 which functions to condense a portion of the gas withdrawn from the well casing into liquid hydrocarbons and collect the gas and liquid hydrocarbons until the gas and the liquid hydrocarbons can be transferred to a retention site for storage or use. In the preferred embodiment, the condensate accumulator 16 is a thirty inch long piece of six inch diameter, $\frac{3}{8}$ inch thick steel pipe with $\frac{3}{8}$ inch thick steel pipe nipples welded over each end. The pressure outlet 22 of vacuum pump 10 is connected to condensate accumulator 16 by line 34 and cooling line 36. Cooling line 36 is supported on the top of condensate accumulator 16 by supports 38 and basically functions to aid condensation of the gas into liquid hydrocarbons. Pressure relief valve 40 is positioned at the end of cooling line 36 and functions to prevent excessive pressure build-up in the condensate accumulator 16. Bleed valve 42 is located in one end of the condensate accumulator 16 and allows the collected liquid hydrocarbons to be removed from the condensate accumulator 16 to a retention site. The high pressure gas outlet valve 44 is located in one end of the condensate accumulator 16 and allows the collected gas to be removed from the condensate accumulator 16 to a retention site.

The vacuum pump 10, motor 18, water accumulator 14 and condensate accumulator 16 are all mounted on frame 12 to enable the user to easily transport and set up the casing vacuum system 8. The components could be attached to frame 12 by a variety of means (e.g., bolted, welded, clamped, etc.). In the preferred embodiment, the components are bolted to frame 12 for easy removal.

Figure 3:
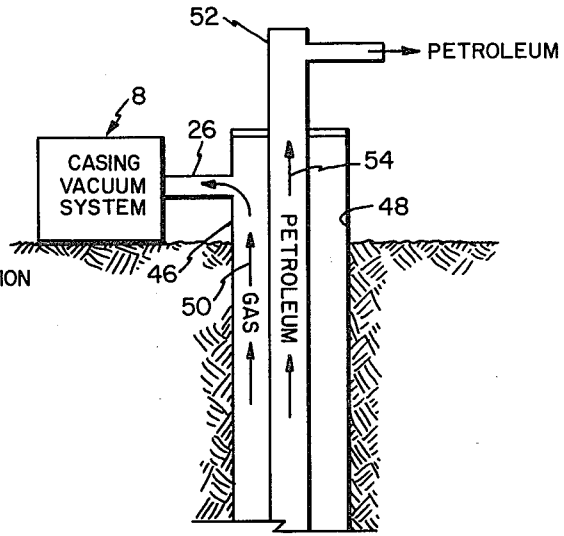
FIG. 3 is a schematic illustration of the present invention connected to the casing of an oil well.

Referring to FIG. 3, there is shown the casing vacuum system 8 connected to the casing 46 of oil well 48 by line 26. The gas within casing 46 is drawn into the casing vacuum system 8 along path 50 when vacuum pump 10 is on. The petroleum is pumped out of the subterranean formation through pipe 52 along path 54.

Although particular embodiments of the invention have been illustrated in the Drawings and described herein, it will be understood that the invention is not limited to such embodiments, but is capable of numerous rearrangements, modifications and variations of parts and elements without departing from the spirit of the invention.

I claim:

1. An apparatus for applying a vacuum to the space within the casing of an oil well in order to improve the recovery of petroleum from the well, comprising:

(a) vacuum pump means having a suction inlet and a pressure outlet;

(b) a water accumulator means connected to the suction inlet of the vacuum pump means for preventing water and/or water vapor from entering the suction inlet of the vacuum pump means;

(c) a condensate accumulator means connected to the pressure oulet of the vacuum pump means for collecting gas which the vacuum means draws from the space within the casing of the oil well, condensing a portion of the gas into liquid hydrocarbons and collecting the liquid hydrocarbons;

and an automatic pressure control means for maintaining the gas pressure in the casing of an oil well within a predetermined range by stopping the vacuum when the pressure is near the lower limit of the predetermined range and reapplying the vacuum when the pressure is near the upper limit of the predetermined range.

2. The apparatus of claim 1, wherein the automatic pressure control includes a mercury vaccum switch.

3. An apparatus for applying a vacuum to the space within the casing of an oil well in order to improve the recovery of petroleum from the well, comprising:

(a) a vacuum pump having a suction inlet and a pressure outlet;

(b) a motor for driving the vacuum pump;

(c) a water accumulator connected between the suction inlet of the vacuum pump and the space within the casing of the oil well casing for preventing water and/or water vapor from entering the vacuum pump;

(d) a condensate accumulator connected to the pressure outlet of the vacuum pump for collecting gas which the vacuum pump draws from the space within the casing of the oil well, condensating a portion of the gas into liquid hydrocarbons and collecting the liquid hydrocarbons; and (e) an automatic pressure control for maintaining the gas pressures in the casing of the oil well within a predetermined range by stopping the vacuum pump when the pressure is near the lower limit of the predetermined range and starting the vacuum pump when the pressure is near the upper limit of the predetermined range.

4. The apparatus of claim 3, wherein the automatic pressure control includes a mercury vacuum switch.

5. The apparatus of claim 3, further comprising a vacuum inlet valve positioned between the water accumulator and the space within the casing of the oil well for regulating the application of the vacuum to the space within the casing of the oil well.

6. The apparatus of claim 3, further comprising an S-shaped tubular line mounted on the top of the condensate accumulator for aiding condensation of the gas into liquid hydrocarbons by cooling the gas.

7. An apparatus for applying a vacuum to the space within the casing of an oil well in order to improve the recovery of petroleum from the well, comprising:

(a) a frame;

(b) a vacuum pump having a suction inlet and a pressure outlet mounted on the frame;

(c) a motor mounted on the frame and drivingly connected to the vacuum pump;

(d) a water accumulator tank connected to the suction inlet of the vacuum pump and mounted on the frame;

(e) a mercury vacuum switch mounted on the water accumulator;

(f) a bleed valve located in one end of the water accumulator for the removal of water accumulated therein;

(g) a vacuum inlet valve positioned between the water accumulator and the space within the casing of the oil well for regulating the application of the vacuum to the space within the casing of the oil well;

(h) a condensate accumulator connected to the pressure outlet of the compressor and mounted on the frame;

(i) a high pressure gas outlet valve mounted in one end of the condensate accumulator for removal of the gas collected therein;

(j) a second bleed valve mounted in one end of the condensate accumulator for removal of the liquid hydrocarbons collected therein;

(k) an S-shaped tubular line connected to both the condensate accumulator and the pressure outlet of the vacuum pump and mounted on the condensate accumulator for further cooling of the gas to promote condensation of the gas into liquid hydrocarbons; and (l) a pressure relief valve connected to the S-shaped tubular line for preventing excessive pressure build-up in the condensate accumulator.

* * * * *